US005358401A

United States Patent [19]

Iwahori et al.

[11] Patent Number: 5,358,401

[45] Date of Patent: Oct. 25, 1994

[54] IGNITION MECHANISM FOR A LIGHTER

[75] Inventors: Masayuki Iwahori, 15-19, Nakada Honmachi, Shizuoka-Shi, Shizuoka-ken; Fukuo Iwahori, Shizuoka, both of Japan

[73] Assignee: Masayuki Iwahori, Shizuoka, Japan

[21] Appl. No.: 42,233

[22] Filed: Apr. 1, 1993

[30] Foreign Application Priority Data

Apr. 9, 1992 [JP] Japan ..... 4-116856
Dec. 22, 1992 [JP] Japan ..... 4-357588

[51] Int. Cl.[5] ..... F23Q 1/02

[52] U.S. Cl. ..... 431/277; 431/153; 431/274

[58] Field of Search ..... 431/277, 153, 274, 275, 431/254

[56] References Cited

U.S. PATENT DOCUMENTS 3,328,980 7/1967 Reim ..... 431/153 X
3,819,320 6/1974 Chevallier ..... 431/277 X
3,827,852 9/1974 Chevallier ..... 431/254
4,457,697 7/1984 Kitabayashi ..... 431/277 X
4,487,570 12/1984 Lowenthal ..... 431/153 X
5,242,297 9/1993 Cirami ..... 431/153

FOREIGN PATENT DOCUMENTS 372989 6/1990 European Pat. Off. ..... 431/277

*Primary Examiner*—Larry Jones
*Attorney, Agent, or Firm*—Harrison & Egbert

[57] ABSTRACT

An ignition mechanism for a lighter for cigarettes, cigars, etc. The ignition mechanism makes a fire surely and easily by a single operation and without staining the thumb of the user. A striker wheel is provided at least on one side thereof with a toothed wheel. An operation member is positioned adjacent the toothed wheel. The operation member is mounted on a shaft so as to be movable up and down and inclinable in the direction of moving to and away from the toothed wheel. The operation member has at least one engagement portion corresponding to the teeth of the toothed wheel. A coiled spring is disposed between the lower end of the operation member and the lighter body. The coiled spring pushes the operation member toward the toothed wheel. The operation member is connected with a nozzle lifting lever so that the nozzle lifting lever lifts the nozzle when the operation member is pushed down.

8 Claims, 7 Drawing Sheets

IGNITION MECHANISM FOR A LIGHTER

BACKGROUND OF THE INVENTION

1. Field of the Invention

The present invention relates to an ignition mechanism for a lighter for cigarettes, cigars, etc. More particularly, it relates to an inexpensive ignition mechanism for a lighter, which mechanism makes a fire surely and easily by a single operation and without staining the thumb of the user.

2. Description of the Prior Art

The following ignition mechanisms have been used in lighters:

(1) Piezoelectric ignition mechanism

This ignition mechanism comprises a piezoelectric element. When the piezoelectric element is given a shock, it discharges electricity to a gas nozzle of a lighter, thereby gas emitted through the gas nozzle being ignited.

(2) Electric ignition mechanism

This ignition mechanism comprises a battery, condenser, and boosting transformer. An electric charge given to and stored in the condenser is discharged to the boosting transformer, thereby gas emitted through the gas nozzle being ignited.

(3) Mechanical ignition mechanism

This ignition mechanism comprises a striker wheel and a flint, said flint being pressed against said striker wheel by the force of a spring. When the striker wheel is rotated, sparks are emitted by friction between the striker wheel and the flint, thereby gas emitted through the gas nozzle being ignited.

The above-mentioned piezoelectric ignition mechanism and electric ignition mechanism have an advantage that they can make a fire by a single operation. However, these mechanisms have a disadvantage that non-conforming articles are often produced because it is difficult to properly set the timing of gas emission or the state of electric discharge. The piezoelectric ignition mechanism and electric ignltion mechanism have a further disadvantage that their production costs are high because they comprise expensive parts such as conductive materials, piezoelectric element, battery, condenser and boosting transformer. The above-mentioned mechanical ignition mechanism have a disadvantage that at the time of ignition the mechanism requires two operations which consist of rotating the striker wheel and pushing down a gas lever. In the conventional mechanical ignition mechanism in which the striker wheel is rotated directly with the thumb, the user may feel pain in the thumb because of the rugged circumference of the striker wheel. Furthermore, the thumb or clothing is often stained with spark residues adhered to the striker wheel.

BRIEF SUMMARY OF THE INVENTION

It is therefore an object of the invention to provide an ignition mechanism for a lighter which mechanism has obviated all the disadvantages of the prior art.

It is another object of the present invention to provide an inexpensive ignition mechanism for a lighter.

It is a further object of the present invention to provide an ignition mechanism for a lighter which mechanism makes a fire surely and easily by a single operation.

It is a still further object of the present invention to provide an ignition mechanism for a lighter which mechanism makes a fire without paining or staining the thumb of the user.

These and other objects have been attained by improving the inexpensive mechanical ignition mechanism. Similarly to said conventional mechanical ignition mechanism, the ignition mechanism of the present invention is adapted to ignite fuel by sparks caused by friction between a striker wheel and a flint, said fuel being emitted through a nozzle, said striker wheel being rotatably mounted in a lighter body, said flint being in spring-supported pressurized contact with said striker wheel. The improvement comprises said striker wheel being provided at least on one side thereof with a toothed wheel, said toothed wheel being coaxial with said striker wheel, an operation member positioned adjacent said toothed wheel, said operation member being mounted on a shaft so as to be movable up and down and inclinable, or adapted to incline, in the direction of moving to and away from said toothed wheel, said operation member having at least one engagement portion corresponding to the teeth of said toothed wheel, said engagement portion being formed in one body with said operation member, said engagement portion preferably being inclinable, or adapted to incline, relatively to said operation member on a hinge portion in the direction of moving to and away from said toothed wheel, a coiled spring disposed between the lower end of said operation member and said lighter body, said coiled spring pushing said operation member toward said toothed wheel, said operation member being connected with a nozzle lifting lever so that the nozzle lifting lever lifts said nozzle when said operation member is pushed down.

To ensure that said coiled spring pushes said operation member toward said toothed wheel, the lower end of said operation member is a slope laving an upward inclination toward said toothed wheel and/or the center of said coiled spring is positioned farther from said toothed wheel than the center of said shaft of said operation member is. In the specification and claims of the present application, the shaft of the operation member means not only a shaft protruding from said operation member but also a shaft protruding from said lighter body.

The operation of the ignition mechanism for a lighter according to the present invention will now be described.

The ignition mechanism according to the present invention makes a fire by a single operation of pushing down the operation member with the thumb. The operation member is inclinable in the direction of moving to and away from the toothed wheel provided on the side of the striker wheel, said operation member being pushed toward the toothed wheel by the coiled spring disposed between the lower end of the operation member and the lighter body. Therefore, when the operation member is pushed down against the force of the coiled spring, the engagement portion of the operation member smoothly engages with a tooth of the toothed wheel and rotates the striker wheel through the toothed wheel.

Particularly in case where the engagement portion is inclinable, relatively to the operation member, on a hinge portion in the direction of moving to and away from the toothed wheel, the angle of rotation of the toothed wheel at each igniting operation is constant. As a result, stable ignition is obtained. If the angle of rotation of the toothed wheel at each igniting operation is not constant, the engagement portion of the operation member may not be sufficiently or properly engaged with a tooth of the toothed wheel at the next igniting operation. Therefore, the lighter may fall to make a fire at the next igniting operation.

When the striker wheel is rotated, sparks are caused by friction between the striker wheel and the flint in spring-supported pressurized contact with said striker wheel. On the other hand, when the operation member is pushed down, the nozzle is lifted by the nozzle lifting lever and fuel is emitted through the nozzle. Thus, the fuel emitted through the nozzle is ignited by the sparks.

When the operation member is released after ignition, the operation member is pushed up by the coiled spring disposed between the lower end of the operation member and the lighter body. The operation member is pushed toward the toothed wheel by the coiled spring but the operation member is inclinable in the direction of moving to and away from the toothed wheel. Therefore, the engagement portion of the operation member smoothly gets over the teeth of the toothed wheel and returns to the original position above the toothed wheel. The engagement portion of the operation member gets over the teeth of the toothed wheel very smoothly particularly in case where the engagement portion is inclinable, relatively to the operation member, on a hinge portion in the direction of moving to and away from the toothed wheel. When the operation member has been moved up by the coiled spring, the nozzle lifting lever is no longer pushed down by the operation member. Therefore, the nozzle is moved down to its original position by a return spring. Now, the nozzle stops emitting fuel and the lighter stops the fire. The lighter is ready for ignition again.

In case where the lower end of the operation member is a slope having an upward inclination toward said toothed wheel, the coiled spring gives the operation member a force which tends to make the lower end of the operation member parallel to the upper end of the coiled spring. Therefore, the operation member is favorably pushed toward the toothed wheel.

In case where the center of the coiled spring is positioned farther from the toothed wheel than the center of the shaft of the operation member is, the coiled spring pushes up the operation member in the direction of inclining the operation member on the shaft toward the toothed wheel. Therefore, the operation member is favorably pushed toward the toothed wheel.

Thus according to the present invention, the user of the lighter can make a fire very easily by a single operation of pushing down the operation member with the thumb. Particularly in case where the engagement portion is inclinable, relatively to the operation member, on a hinge portion in the direction of moving to and away from the toothed wheel, stable ignition is obtained and thereafter the operation member smoothly returns to its original position. Since the user does not have to rotate the striker wheel directly with the thumb, the user does not feel pain in the thumb by the rugged circumference of the striker wheel, and the thumb or clothing is free from being stained with spark residues adhered to the striker wheel. Since the ignltion mechanism of the present invention has a simple mechanical construction, it is easy to manufacture and surely ignites fuel. Also, the ignition mechanism of the present invention is produced at low costs because it does not use expensive parts such as conductive materials, piezoelectric element, battery, condenser and boosting transformer.

DETAILED DESCRIPTION

Figure 1:
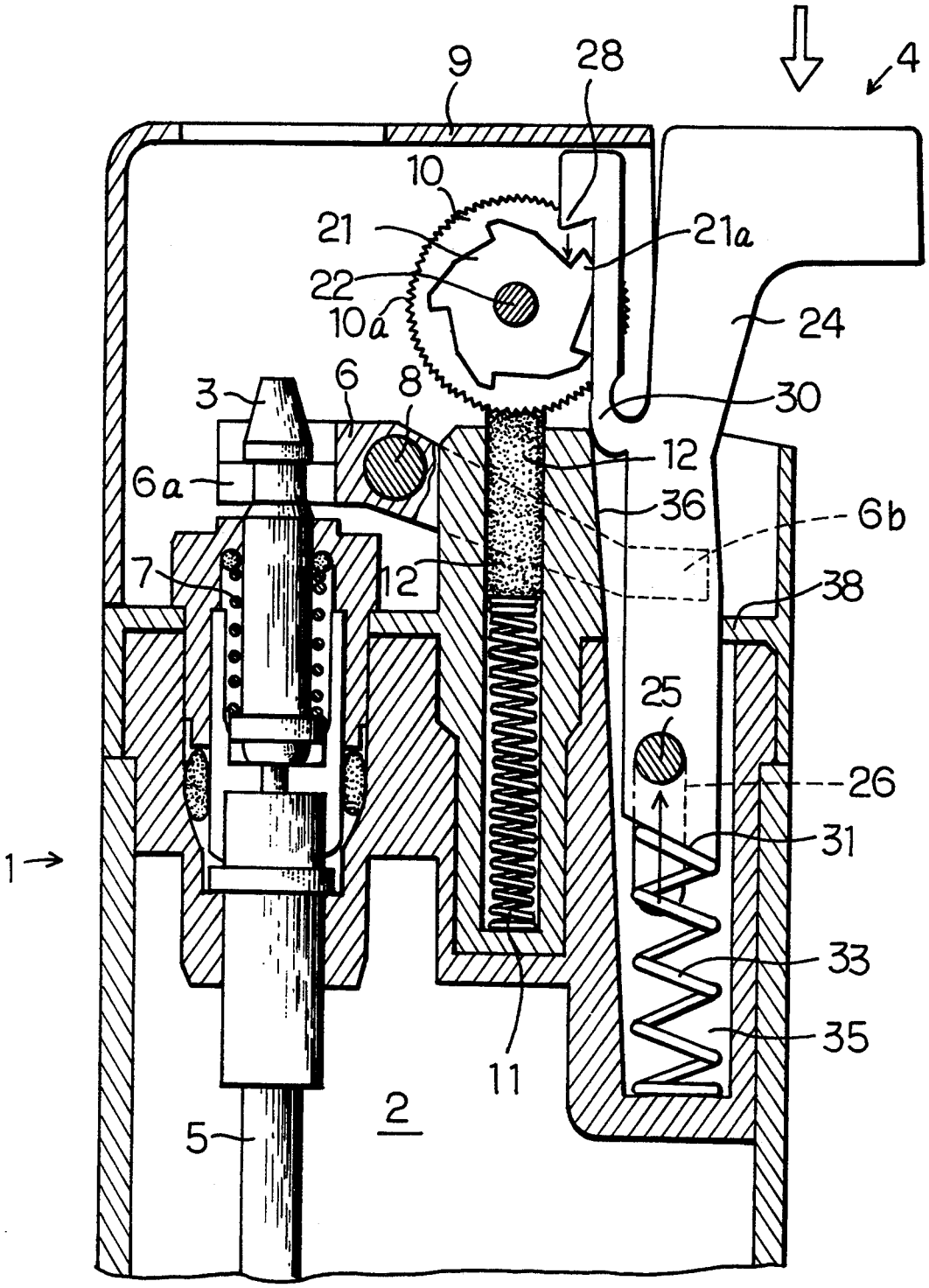
FIG. 1 is a sectional view showing an ignition mechanism for a lighter according to the present invention, which mechanism is ready for ignition.

The present invention will now be described in detail with reference to the attached drawings.

A lighter in the present invention comprises a lighter body 1, a fuel well 2 disposed within said lighter body 1, a nozzle 3 disposed above said fuel well 2, said nozzle 3 emitting fuel from said fuel well 2, and an ignition mechanism 4 for igniting fuel emitted through said nozzle 3. The lighter body 1 is preferably made of a plastic. The fuel contained in said fuel well 2 may be butane for example. The fuel in the fuel well 2 is sucked up by a fuel sucking means 5 and emitted through the nozzle 3 in a gasified state. The nozzle 3 is engaged with a front end *6a* (left end in the drawings) of a nozzle lifting lever 6 so as to be lifted thereby. The nozzle 3 is provided with a return spring 7 for returning the nozzle 3 from a lifted position. The nozzle lifting lever 6 is mounted on a shaft 8 so as to turn. Numeral 9 represents a protection from wind.

Similarly to the conventional mechanical ignition mechanism, the ignition mechanism 4 of the present invention comprises a striker wheel 10 having a rough ridged circumference *10a*, a flint 12 pressed against said striker wheel 10 by the force of a spring 11, fuel emitted through the nozzle 3 being ignited by sparks caused by friction between said striker wheel 10 and said flint 12.

The differences of the ignition mechanism of the present invention from the conventional mechanical ignition mechanism will now be described.

Figure 5:
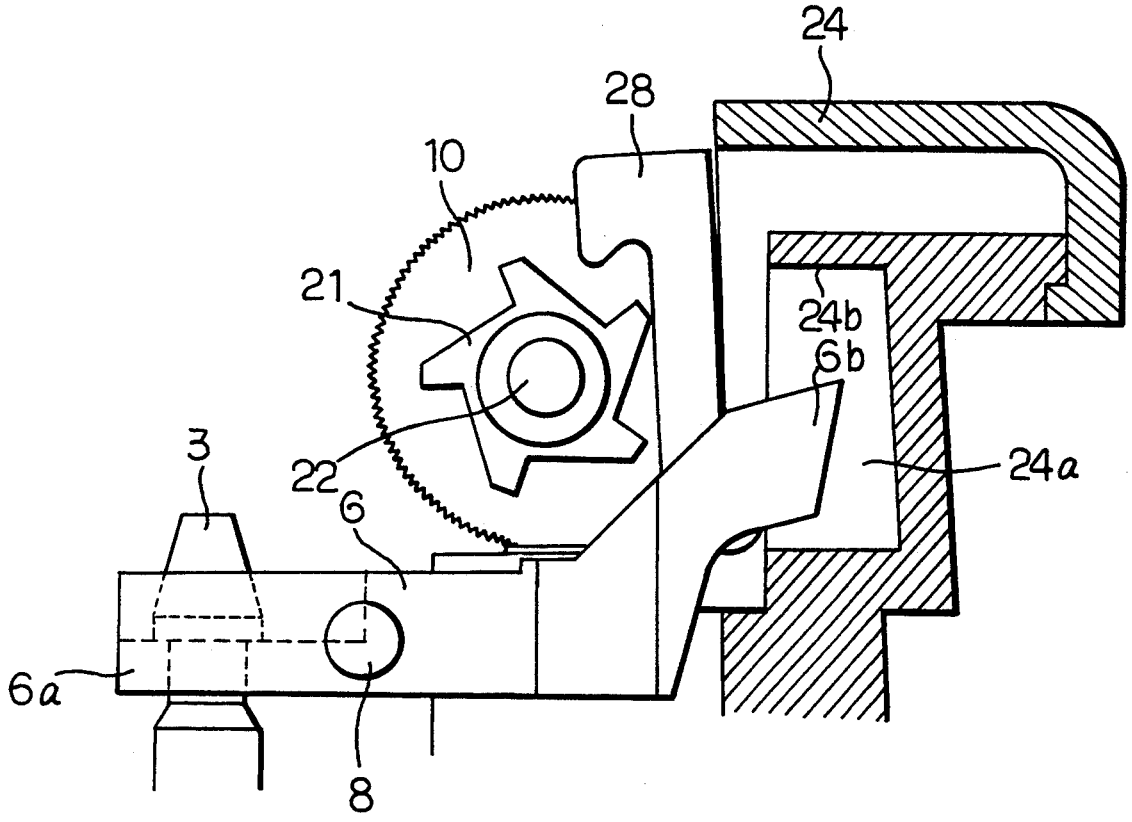
FIG. 5 is a sectional view showing a relationship between said operation member and a nozzle lifting lever.

Embodiments shown in FIGS. 1 to 5:

Said striker wheel 10 is provided at least on one side thereof with a toothed wheel 21, said toothed wheel 21 being coaxial with the striker wheel 10. The toothed wheel 21 may be either fixed to the shaft 22 of the striker wheel 10 or formed in one body with the striker wheel 10. The toothed wheel 21 may be disposed either on one side or on two sides of said striker wheel 10. An operation member 24 made of a plastic for example is positioned adjacent said toothed wheel 21. The operation member 24 is mounted on a shaft 25 so as to be movable up and down and inclinable in the direction of moving to and away from the toothed wheel 21. For example, the operation member 24 is provided with a horizontal shaft 25 protruding therefrom, said shaft 25 being inserted into a vertically elongated hole 26 formed in the lighter body 1. Or alternatively, the operation member 24 is provided with a vertically elongated hole, into which a horizontal shaft protruding from the lighter body 1 is inserted. The operation member 24 has at least one engagement portion 28 corresponding to the teeth 21*a* of the toothed wheel 21. The operation member 24 has one engagement portion 28 if the toothed wheel 21 is provided only on one side of the striker wheel 10. The operation member 24 has two engagement portions 28 if the toothed wheel 21 is provided on two sides of the striker wheel 10. The engagement portion 28 is formed in one body with the is operation member 24. The engagement portion 28 is inclinable, relatively to the operation member 24, on a hinge portion 30 in the direction of moving to and away from the toothed wheel 21. A coiled spring 33 is disposed between the lower end 31 of the operation member 24 and the lighter body 1. The coiled spring 33 pushes the operation member 24 toward the toothed wheel 21. The operation member 24 is connected with said nozzle lifting lever 6 so that the nozzle lifting lever 6 lifts said nozzle 3 when the operation member 24 is pushed down. For example, the operation member 24 is provided with a lever receiving hole 24*a*, into which a corresponding end (right end in FIG. 5) 6*b* of said nozzle lifting lever 6 is inserted as shown in FIG. 5. In this example, when the operation lever 24 is pushed down, the upper surface 24*b* of the lever receiving hole 24*a* in the operation member 24 contacts and pushes down said corresponding end 6*b* of the nozzle lifting lever 6. Therefore, the nozzle lifting lever 6 is turned clockwise in FIG. 5 and lifts said nozzle 3.

Figure 2:
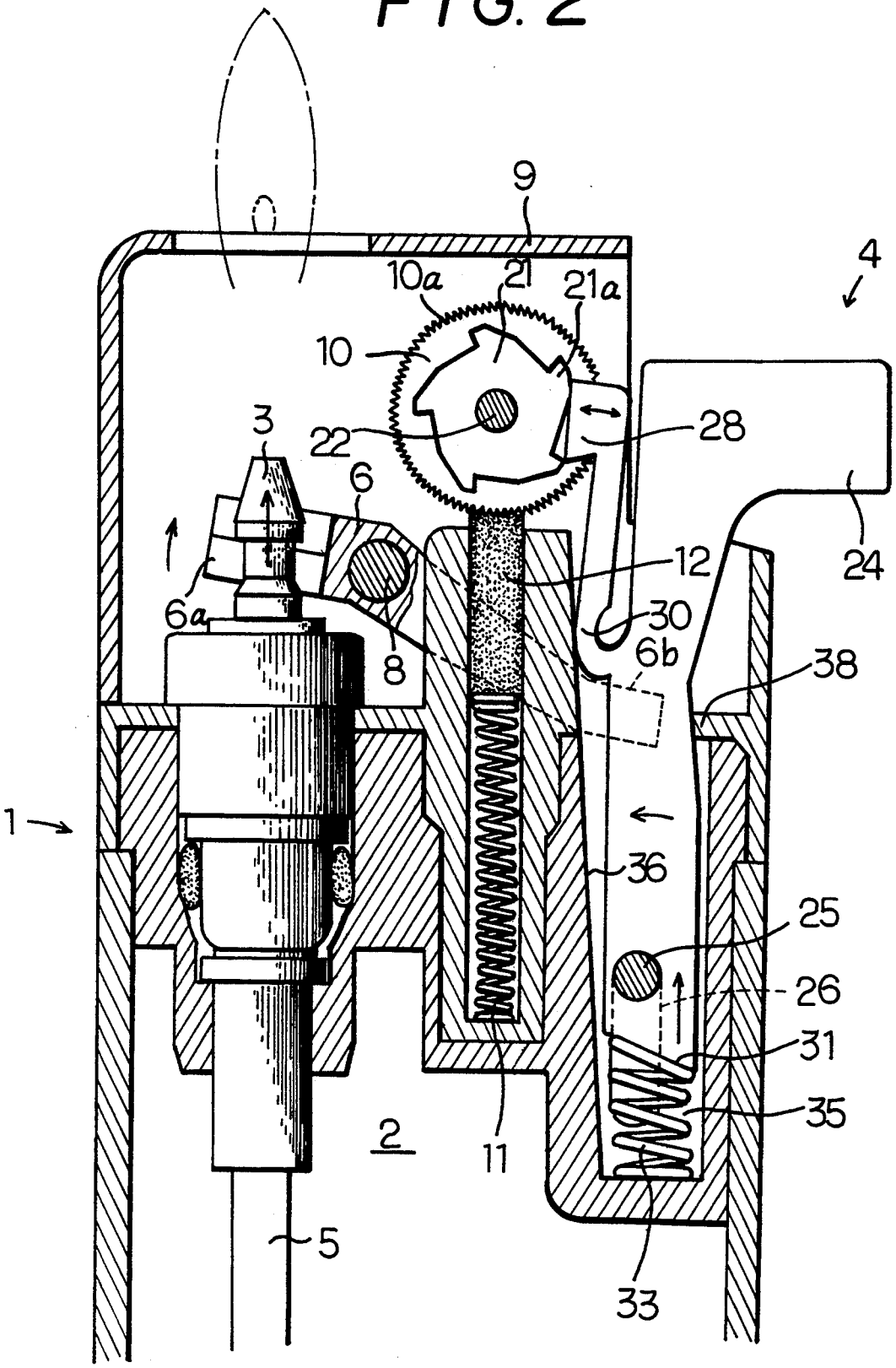
FIG. 2 is a sectional view showing said ignition mechanism in which an operation member is pushed down and a fire is made.
Figure 3:
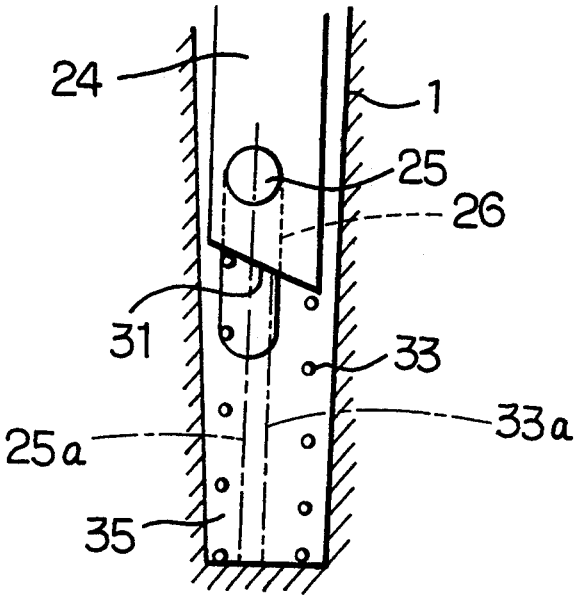
FIG. 3 is a sectional view showing a relationship between said operation member and a coiled spring.
Figure 4:
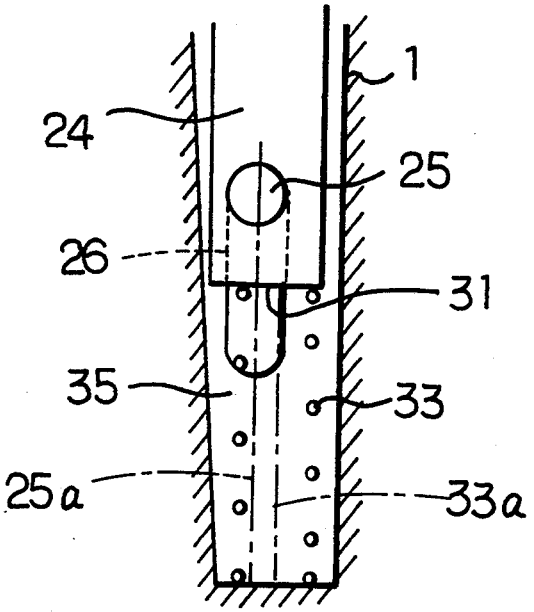
FIG. 4 is a sectional view showing another relationship between said operation member and said coiled spring.

To ensure that said coiled spring 33 pushes the operation member 24 toward said toothed wheel 21, the lower end 31 of the operation member 24 is a slope having an upward inclination toward the toothed wheel 21 as shown FIGS. 1 and 2 or alternatively the center 33*a* of the coiled spring 33 is positioned farther from the toothed wheel 21 than the center 25*a* of said shaft 25 of the operation member 24 is as shown in FIG. 4. In an example shown in FIG. 3, the lower end 31 of the operation member 24 is a slope having an upward inclination toward the toothed wheel 21 and at the same time the center 33*a* of the coiled spring 33 is positioned farther from the toothed wheel 21 than the center 25*a* of the shaft 25 of the operation member 24 is.

The operation member 24 is inserted into a guide hole 35. An inner wall 36, near said toothed wheel 21, of the guide hole 35 is slightly inclined in the direction of making the guide hole 35 narrower downward. The guide hole 35 is provided on the opposite inner wall with a projection 38. The role of the inclination of the inner wail 36 and the projection 38 is to limit the horizontal movement of the operation member 24.

Figure 6:
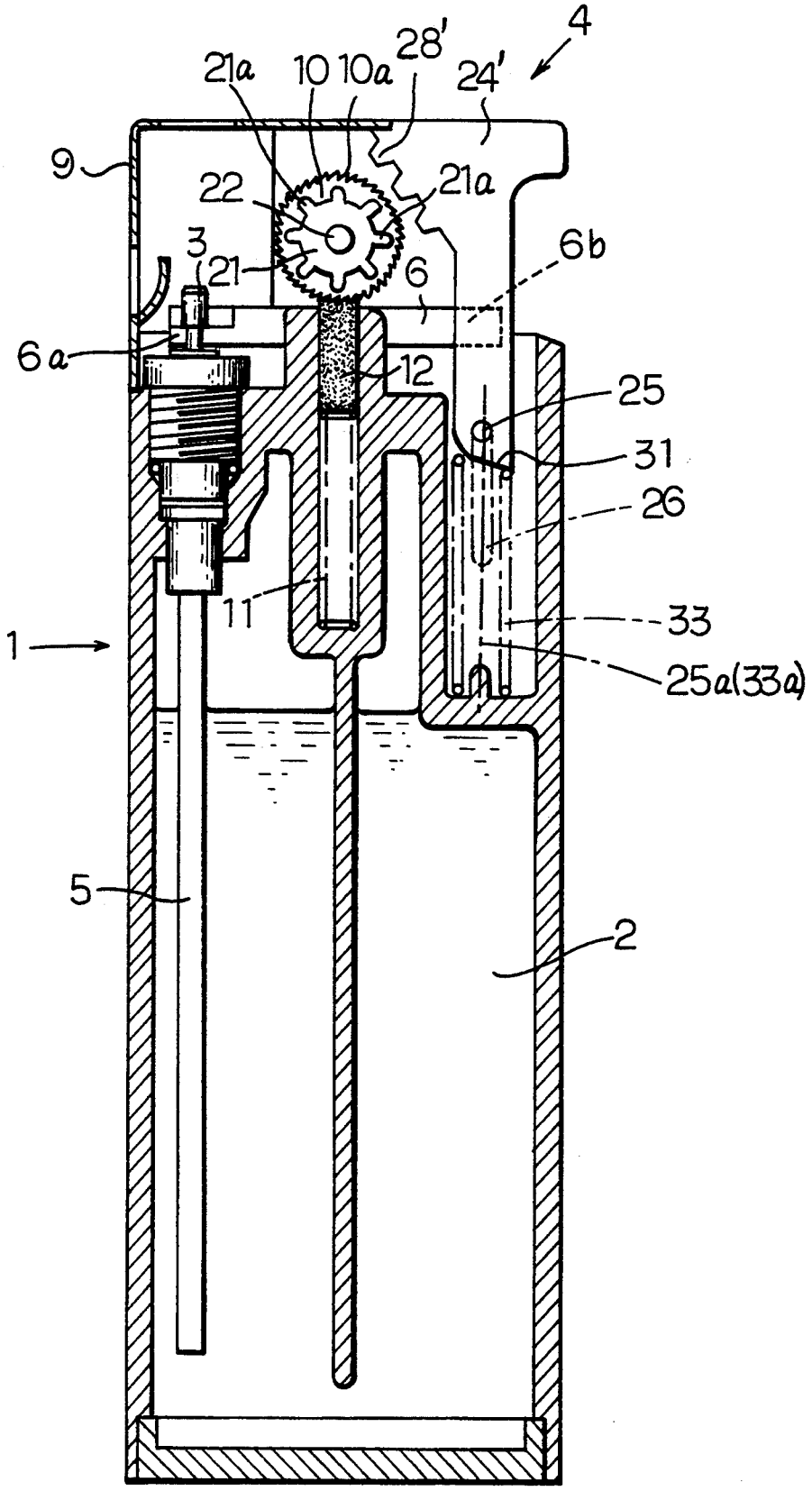
FIG. 6 is a sectional view showing another ignition mechanism for a lighter according to the present invention, which mechanism is ready for ignition.
Figure 7:
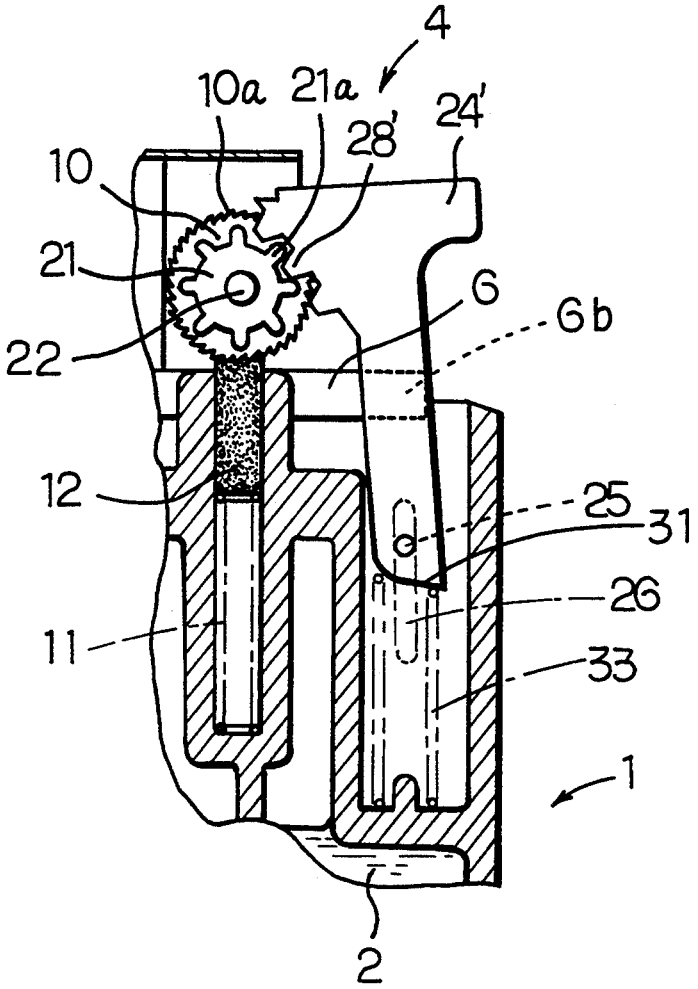
FIG. 7 is a sectional view showing said ignition mechanism in which an operation member is being pushed down.
Figure 8:
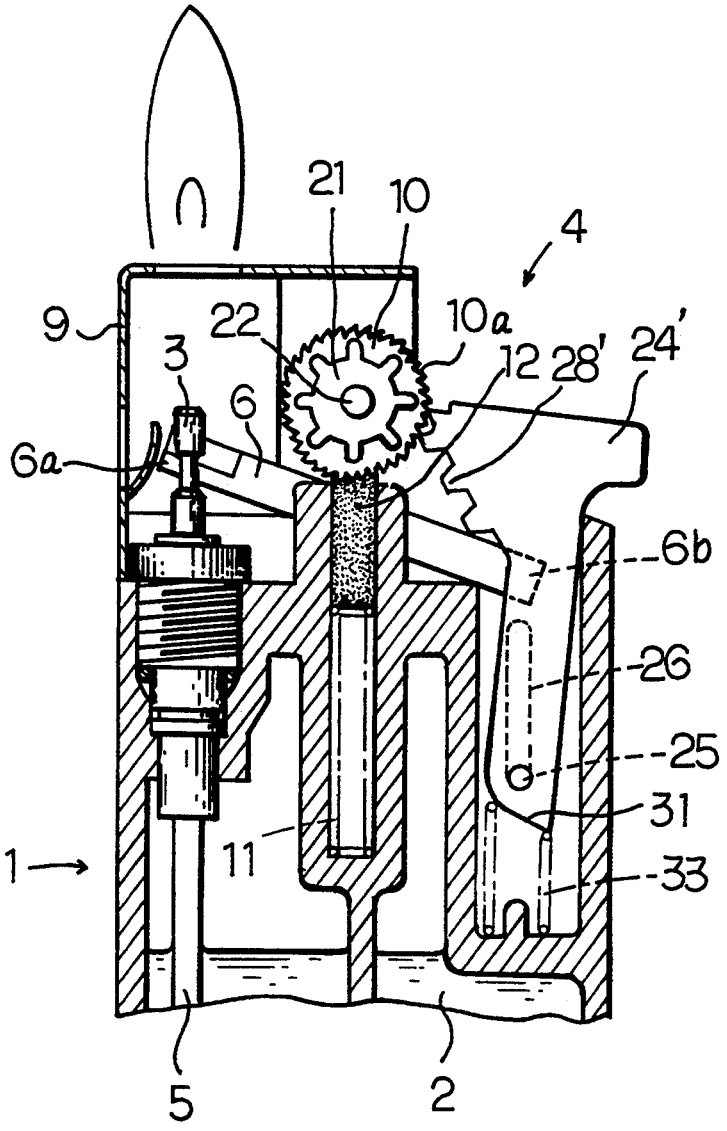
FIG. 8 is a sectional view showing said ignition mechanism in which said operation member has been pushed down and a fire is made.

Embodiment shown in FIGS. 6 to 8:

The ignition mechanism shown in FIGS. 6 to 8 is substantially the same as the ignition mechanism shown in FIGS. 1 and 2 except that the operation member 24' does not have a hinge portion 30 and the engagement portion 28' of the operation member 24' is not movable relatively to the operation member 24'. In FIGS. 6 to 8, to ensure that the coiled spring 33 pushes the operation member 24' toward the toothed wheel 21, the lower end 31 of the operation member 24' is a slope having an upward inclination toward the toothed wheel 21, the center 33*a* of the coiled spring 33 being aligned with the center 25*a* of the shaft 25 of the operation member 24'. However, it is also possible to position the center 33*a* of the coiled spring 33 farther from the toothed wheel 21 than the center 25*a* of the shaft 25 of the operation member 24' is as shown in FIG. 4. Furthermore, it is possible that the lower end 31 of the operation member 24 is a slope having an upward inclination toward the toothed wheel 21 and at the same time the center 33*a* or the coiled spring 33 is positioned farther from the toothed wheel 21 than the center 25*a* of the shaft 25 of the operation member 24' is. In FIGS. 6 to 8, parts and portions identical or corresponding to those in FIGS. 1 to 5 are represented by the same symbols as those in FIGS. 1 to 5.

What is claimed is:

1. An ignition mechanism for a lighter adapted to ignite fuel by sparks caused by friction between a striker wheel and a flint, said fuel being emitted through a nozzle, said striker wheel being rotatably mounted in a lighter body, said flint being in spring-supported pressurized contact with said striker wheel, the improvement comprising said striker wheel being provided at least on one side thereof with a toothed wheel, said toothed wheel being coaxial with said striker wheel, an operation member positioned adjacent said toothed wheel, said operation member being mounted on a shalt so as to be movable up and down and inclinable in the direction of moving to and away from said toothed wheel, said operation member having at least one engagement portion corresponding to the teeth of said toothed wheel, said engagement portion being integrally formed with said operation member, said engagement portion being inclinable relative to said operation member on a hinge portion in the direction of moving to and away from said toothed wheel, a coiled spring disposed between the lower end of said operation member and said lighter body, said coiled spring pushing said operation member toward said toothed wheel, said operation member being connected with a nozzle lifting lever so that the nozzle lifting lever lifts said nozzle when said operation member is pushed down.

2. An ignition mechanism for a lighter as claimed in claim 1 wherein the lower end of said operation member slopes upwardly toward said toothed wheel.

3. An ignition mechanism for a lighter as claimed in claim 1 wherein the center of said coiled spring is positioned farther from said toothed wheel than the center of said shaft of said operation member is.

4. An ignition mechanism for a lighter as claimed in claim 1 wherein the lower end of said operation member slopes upwardly toward said toothed wheel and the center of said coiled spring is positioned farther from said toothed wheel than the center of said shaft of said operation member is.

5. An ignition mechanism for a lighter adapted to ignite fuel by sparks caused by friction between a striker wheel and a flint, said fuel being emitted through a nozzle, said striker wheel being rotatably mounted in a lighter body, said flint being in spring-supported pressurized contact within said striker wheel, the improvement comprising said striker wheel being provided at least on one side thereof with a toothed wheel, said toothed wheel being coaxial with said striker wheel, an operation member positioned adjacent said toothed wheel, said operation member being mounted on a shaft so as to be movable up and down and inclinable in the direction of moving to and away from said toothed wheel, said operation member having at least one engagement portion corresponding to the teeth of said toothed wheel, said engagement portion being integrally formed with said operation member, a coiled spring disposed between the lower end of said operation member and said lighter body, said coiled spring pushing said operation member toward said toothed wheel, said operation member being connected with a nozzle lifting lever so that the nozzle lifting lever lifts said nozzle when said operation member is pushed down.

6. An ignition mechanism for a lighter as claimed in claim 5 wherein the lower end of said operation member slopes upwardly toward said toothed wheel.

7. An ignition mechanism for a lighter as claimed in claim 5 wherein the center of said coiled spring is positioned farther from said toothed wheel than the center of said shaft of said operation member is.

8. An ignition mechanism for a lighter as claimed in claim 5 wherein the lower end of said operation member slopes upwardly toward said toothed wheel and the center of said coiled spring is positioned farther from said toothed wheel than the center of said shaft of said operation member is.

* * * * *